US005188097A

United States Patent [19]

Hansen

[11] Patent Number: 5,188,097

[45] Date of Patent: Feb. 23, 1993

[54] CAPILLARY MASSAGE APPARATUS

[76] Inventor: Carlos F. G. Hansen, Salguero 2567 - 12 "B", (1425) Buenos Aires, Argentina

[21] Appl. No.: 731,065

[22] Filed: Jul. 17, 1991

[30] Foreign Application Priority Data

Jul. 19, 1990 [AR] Argentina ..... 317406
Jun. 3, 1991 [AR] Argentina ..... 319845

[51] Int. Cl.[5] ..... A61H 1/00; A61H 7/00

[52] U.S. Cl. ..... 128/36; 128/60; 128/62 R

[58] Field of Search ..... 128/32, 35, 36, 60, 128/61, 62 R, 34, 44, 24.2, 59

[56] References Cited

U.S. PATENT DOCUMENTS 3,481,326 12/1969 Schamblin ..... 128/32
3,557,781 1/1971 Kaye ..... 128/32 X
3,763,853 10/1973 Jochimski ..... 128/36
3,890,963 6/1975 Patterson ..... 128/33 X
3,984,101 10/1976 Garza ..... 128/33 X
4,469,092 9/1984 Marshall et al. ..... 128/36
4,765,316 8/1988 Marshall ..... 128/36
5,081,986 1/1992 Cho ..... 128/58 X

*Primary Examiner*—Robert A. Hafer
*Assistant Examiner*—Brian E. Hanlon
*Attorney, Agent, or Firm*—Lowe, Price, LeBlanc & Becker

[57] ABSTRACT

A device for administering capillary massages to enhance the growth of hair and prevent its loss by improving the blood circulation in the head, comprises a massaging helmet, which on its interior has multiple nodes or protuberances which rest against the scalp, and which are vibrated by electric motor means. The device is secured under the armpits of the individual by means of a harness.

10 Claims, 2 Drawing Sheets

CAPILLARY MASSAGE APPARATUS

TECHNICAL FIELD

This invention refers to a device for capillary massage, aimed at favoring hair growth and eliminating hair loss. This is achieved through improvement of blood circulation in the head.

More specifically, this device is a massaging helmet which is equipped on the inside with multiple nodes or protuberances which rest against the scalp, and which is secured to the individual by means of a harness which passes under the armpits.

It is a known fact that hair growth is enhanced by capillary massage, but heretofore such massages could only be given manually or with hand-held vibrator devices.

It is also known that the success of capillary massage depends fundamentally on the frequency with which it is given and that its effectiveness is directly related to the duration of each massage.

A disadvantage of manual capillary massage is that it must be done by another person, and capillary massage employing hand-held devices has the disadvantage of being fatiguing, which with the passage of time, leads to cutting down on the period of application. Also it is difficult to regulate the desired pressure of the massage.

The objective of this invention, then, is to provide a device especially suited for administration of capillary massages without the requirement for a masseuse or the use of one's hands, and which also provides a constant and desired pressure throughout the massage.

The fact that the hands are not used in giving the massage means that while the invented massaging device is in operation, other tasks may be accomplished.

The object of this invention, then, is a capillary massage device in the form of a helmet which comprises an outer shell and an inner liner, secured firmly to one another, the inner liner being provided on its outer surface with an anti-slip cover, and on its inner surface, inside the helmet shell, equipped with an electric motor connected to eccentric wheel means such as a flywheel, this inner liner being associated with an elastic harness to secure it to the user.

This invention will be better understood by referring to the drawings, which represent a preferred, though not limitative form of the invention.

Figure 3:
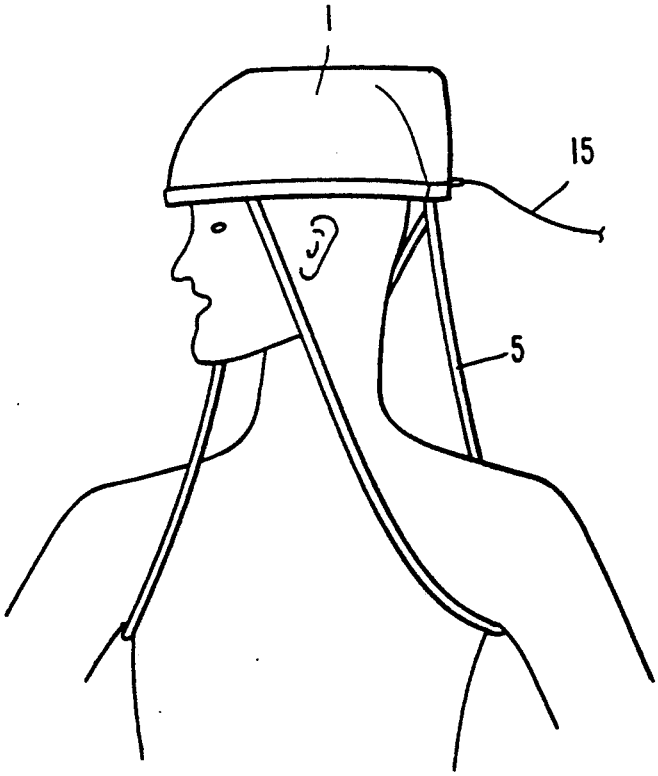

FIG. 3 schematically illustrates one way of utilizing the device.

Figure 1:
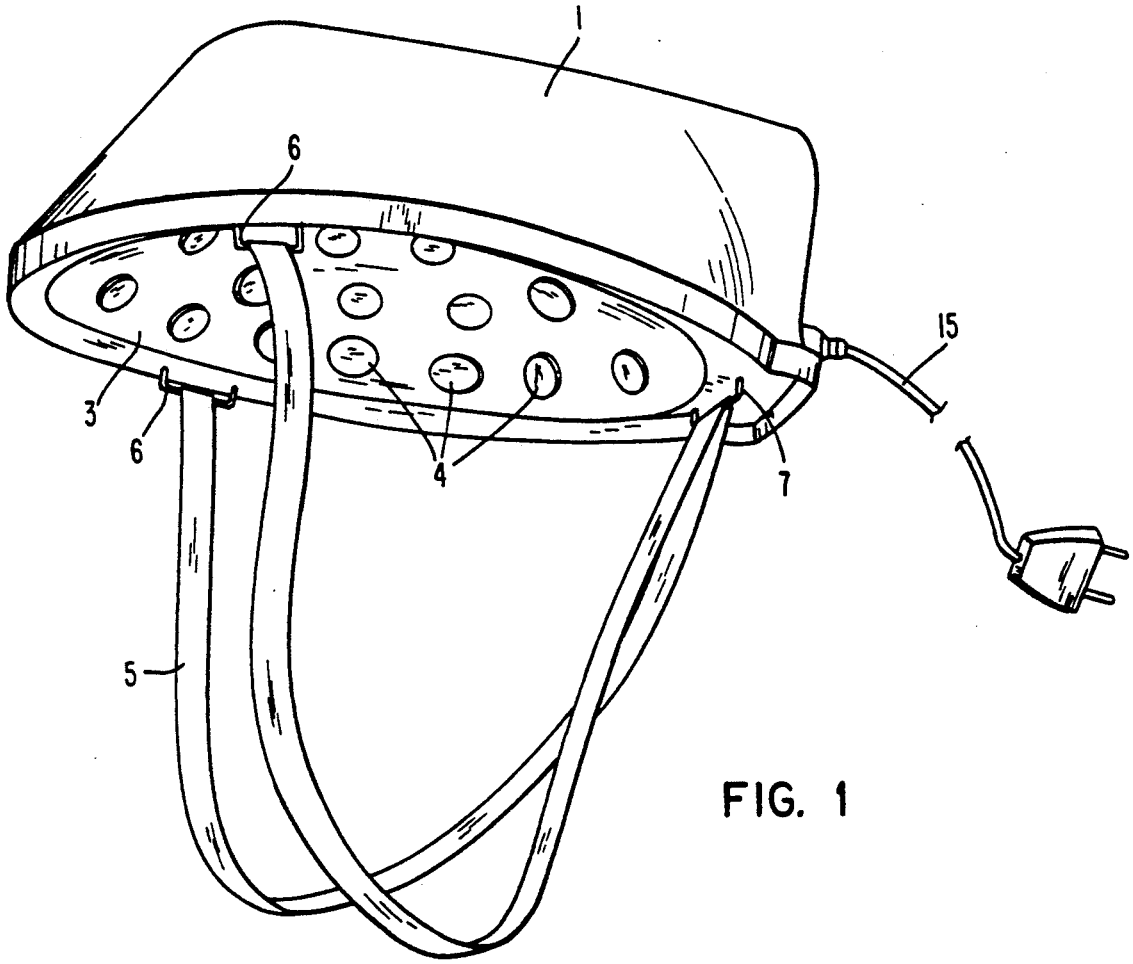
FIG. 1 is a perspective view of the device which is the object of the invention.
Figure 2:
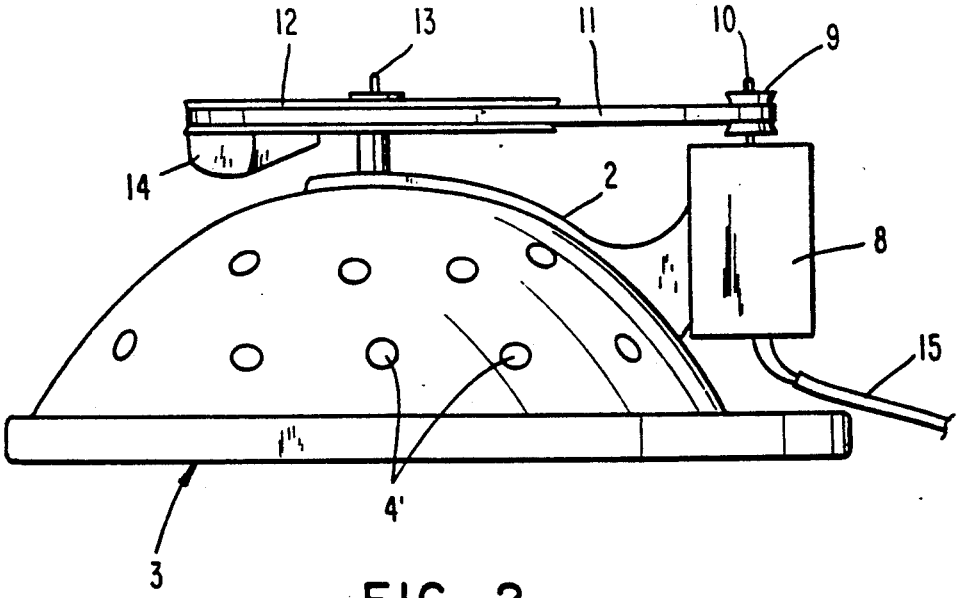
FIG. 2 is a side view of the interior of the invented device.

FIGS. 1 and 2 represent the device which is object of the invention, which is comprised of: a helmet shell 1, preferably constructed of plastic material; an inner liner 3 of plastic material, provided with an anti-slip massaging cover, which might be a latex surface, or may be formed with multiple nodes 4, preferably of rubber, latex, PVC or the like, distributed throughout the inner surface of the said inner liner 3; and an elastic harness 5, comprising an elastic band, the ends of which are secured to two clip means 6 mounted on the sides of the inner liner 3 and which passes through another clip means 7, it being possible for clips means 6 and 7 to be removable.

FIG. 2 shows the upper portion of inner liner 3, in which can be seen a compartment 8 for the mentioned electric motor, which, in this preferred form is connected by means of a pulley 9 mounted on a shaft 10, through a belt 11, to a pulley 12 of greater diameter, mounted with free rotational movement around a shaft 13 which is affixed to the upper portion of the said inner liner 3. This pulley 12 is provided in its lower portion with a weight 14, which is eccentric, i.e. a flywheel, with respect to the said shaft 13.

Also shown are the connection cable 15 for the electric motor, not shown, and the outer portions 4' of the nodes 4.

The said compartment 8 can be secured to the inner liner 3 by means of a base 2, or can be an integral part of the said inner liner 3.

Also by preference, a 12 V DC permanent-magnet electric motor is used, connected to the line by means of a suitable transformer of either 220V-12V or 110V-12V.

The desired capillary massage is accomplished by the movement of the inner liner 3, produced by the flywheel or eccentric weight 14 in rotation driven by the electric motor, effecting in this case, a massaging action of the nodes 4 which rest against the user's head and transmit the movement of the liner 3 to the scalp. In the case wherein the inner liner is furnished with an anti-slip surface, it is this surface which massages the scalp.

The desired pressure is obtained through adjustment of the elastic harness 5, placed as shown in FIG. 3, through regulatory means not shown, which might be buckles, "Velcro" or regulatory means in general.

Obviously, the transmission of movement from the motor's drive shaft to the eccentric weight or flywheel 14 can be accomplished in a variety of ways, for example, by means of coupled gears, or through friction or rubbing action, without thereby departing from the scope of the invention.

It is clear that due to the elastic harness 5, which holds the helmet 1 in its operating position, the user's hands remain free to carry out other types of tasks, and to the extent permitted by the cable 15, the user can move about freely.

This means that the invented capillary massage helmet can be used anywhere, in the office, while watching television, and, with the use of a cigarette lighter adapter, even while driving an automobile.

I claim:

1. A device for capillary massage, in the form of a helmet, which comprises a helmet shell and an inner liner, said helmet shell and inner liner being attached together, said inner liner having attached thereto an elastic harness which secures it to a user, the inner liner being provided on its outer surface with an anti-slip cover and on its inner surface, arranged inside the helmet shell, with an electric motor connected to eccentric wheel means, said eccentric wheel means being mounted for free rotational movement around a shaft which is affixed firmly to said inner liner, said rotational movement around said shaft and said elasticity of said harness providing an asymmetrical motion to at least said helmet shell, inner liner and said anti-slip cover to provide a capillary massaging effect.

2. A device in accordance with claim 1, wherein the said anti-slip massaging cover consists of multiple nodes fabricated of a material selected from among rubber, latex, polyvinylchloride or the like.

3. A device in accordance with claim 1, wherein the said anti-slip massaging cover consists of a latex surface.

4. A device in accordance with claim 1, wherein the said electric motor is a 12V DC permanent-magnet electric motor.

5. A device in accordance with claim 1, wherein the said electric motor and the said eccentric wheel means are connected by a belt.

6. A device in accordance with claim 1, wherein the said eccentric wheel means is a flywheel which receives a belt for connection with the motor.

7. A device in accordance with claim 1, wherein the outer helmet shell has a protuberance for housing the said motor.

8. A device in accordance with claim 1, wherein the said eccentric wheel means consists of a weight offset from a shaft, said shaft being affixed firmly to the said inner liner.

9. A device in accordance with claim 1, wherein the said elastic harness consists of an elastic strap.

10. A device in accordance with claim 9, wherein the said elastic harness is secured to the said inner liner by two holding devices provided at the ends of the elastic strap and another holding device on which the said elastic strap is mounted and through which it passes by slippage.

* * * * *